US011976520B2

(12) United States Patent
Steele et al.

(10) Patent No.: US 11,976,520 B2
(45) Date of Patent: May 7, 2024

(54) ELECTRICAL TRANSMISSION IN A WELL USING WIRE MESH

(71) Applicant: Halliburton Energy Services, Inc., Houston, TX (US)

(72) Inventors: David Joe Steele, Carrollton, TX (US); Justin Mark Roberts, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 48 days.

(21) Appl. No.: 17/535,390

(22) Filed: Nov. 24, 2021

(65) Prior Publication Data

US 2022/0178211 A1 Jun. 9, 2022

Related U.S. Application Data

(60) Provisional application No. 63/118,830, filed on Nov. 27, 2020.

(51) Int. Cl.
*E21B 17/02* (2006.01)
*E21B 17/00* (2006.01)
(Continued)

(52) U.S. Cl.
CPC ..... *E21B 17/003* (2013.01); *E21B 17/023* (2013.01); *E21B 17/028* (2013.01); *E21B 41/0035* (2013.01); *E21B 47/12* (2013.01)

(58) Field of Classification Search
CPC .... E21B 17/003; E21B 17/023; E21B 17/028; E21B 41/0035; E21B 47/12
See application file for complete search history.

(56) References Cited

U.S. PATENT DOCUMENTS 6,776,636 B1 8/2004 Cameron et al.
7,228,898 B2 6/2007 Grigsby et al.
(Continued)

FOREIGN PATENT DOCUMENTS

AU 2014400608 1/2016
CA 2898734 8/2020
(Continued)

OTHER PUBLICATIONS

Manara production and reservoir management system, Schlumberger, 2020.

(Continued)

*Primary Examiner* — D. Andrews
(74) *Attorney, Agent, or Firm* — Scott Richardson; C. Tumey Law Group PLLC

(57) ABSTRACT

A well system incorporates electrically conductive mesh providing robust, reliable electrical communication pathways along portions of tubular equipment. An example system comprises a tubular string disposed in a wellbore, such as a multilateral wellbore. The tubular string defines an internal fluid flow path for conveying fluids to or from a surface of a wellsite. The tubular string also includes a plurality of well components with tubular component bodies arranged along the tubular string. An electrical network along the tubular string interconnects the well components. The electrical network comprising a transmission path defined at least in part by a mesh sleeve disposed along the tubular string around the internal fluid flow path.

16 Claims, 6 Drawing Sheets

(51) Int. Cl.
*E21B 41/00* (2006.01)
*E21B 47/12* (2012.01)

(56) References Cited

U.S. PATENT DOCUMENTS

| | | | | |
|---|---|---|---|---|
| 7,510,003 | B2 | 3/2009 | Meijer et al. | |
| 7,640,977 | B2 | 1/2010 | Jonas | |
| 7,735,555 | B2 | 6/2010 | Patel et al. | |
| 8,056,619 | B2 | 11/2011 | Patel et al. | |
| 10,301,888 | B2 | 5/2019 | Richards et al. | |
| 10,344,570 | B2 | 7/2019 | Steele | |
| 2006/0021799 | A1 | 2/2006 | Hall et al. | |
| 2012/0013482 | A1 | 1/2012 | Patel et al. | |
| 2012/0305267 | A1 | 12/2012 | Steele | |
| 2015/0009040 | A1* | 1/2015 | Bowles | E21B 17/003 340/854.6 |
| 2016/0145956 | A1 | 5/2016 | Dahl et al. | |
| 2017/0234113 | A1 | 8/2017 | Steele | |
| 2019/0316460 | A1* | 10/2019 | Mannas | E21B 36/00 |
| 2020/0256128 | A1 | 8/2020 | Cho et al. | |

FOREIGN PATENT DOCUMENTS

| | | |
|---|---|---|
| EP | 2414622 | 11/2017 |
| EP | 2591201 | 10/2019 |
| WO | 2018222197 A1 | 12/2018 |
| WO | 2018222198 | 12/2018 |
| WO | 2019-125409 | 6/2019 |

OTHER PUBLICATIONS

Manara system in multilateral wells, Schlumberger. Accessed Feb. 1, 2022. Available at https://www.slb.com/completions/well-completions/intelligent-completions/intelligent-completion-systems/manara-production-and-reservoir-management/multilateral-wells.

Halliburton, FlexRite, Electrical Linear Actuator Concepts, Nov. 24, 2020.

Intelligent Completions, Smartwell intelligent completion systems, Halliburton. Accessed Feb. 1, 2022. Available at https://www.halliburton.com/en/products/smartwell-technology-enhanced-functionality.

Well Completions, Intelligent Completions, DataSphere@ LinX® Monitoring System, Halliburton, H012113, May 2021.

International Search Report and Written Opinion for Application No. PCT/US2021/060858, dated Mar. 17, 2022.

Office Action Summary for U.S. Appl. No. 17/535,395 dated Nov. 2, 2023. PDF file. 9 pages.

* cited by examiner

ELECTRICAL TRANSMISSION IN A WELL USING WIRE MESH

CROSS-REFERENCE TO RELATED APPLICATIONS

The present application is a non-provisional of U.S. patent application Ser. No. 63/118,830, the entire disclosure of which is incorporated herein by reference.

BACKGROUND

Intelligent well completions systems are used to remotely control and monitor reservoir zones in a well. Generally intelligent well completions systems include valves, as well as other features, configured to provide flow control within the well. Power and communication signals may be provided to the valves from the surface via wiring extending from the surface and through casing of the intelligent well completions system. However, connecting the valves and other features to the surface in a multilateral well requires a more complex system that provides connections to a plurality of downhole valves that may be disposed in the main wellbore as well as in wellbore branches extending out from the main wellbore. Unfortunately, traditional systems for splitting the connection from the main wellbore to the wellbore branches may provide unreliable connections, which may hinder efficiency of well production operations.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
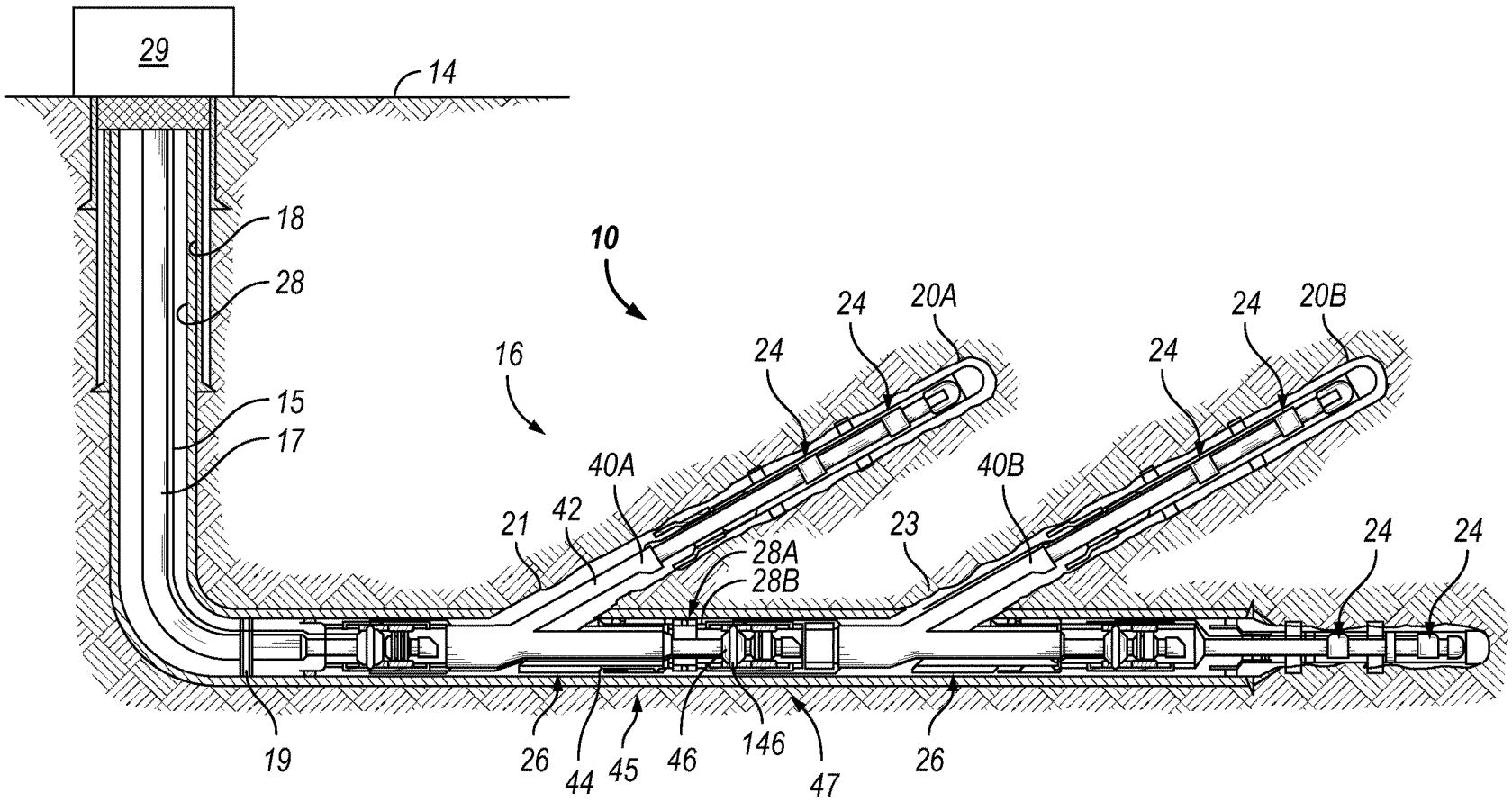
FIG. 1 is an elevation view of a completions system in a multilateral well as an example of a well system in which embodiments of the present disclosure may be implemented.

A well system is disclosed wherein an electrically conductive mesh is selectively incorporated into electrical communication pathways of tubular equipment, providing a network of electrical and fluid communication pathways between downhole components. The system may include a string of interconnected tubular components, such as multilateral junctions and deflectors, and tubular segments connected therebetween. The tubular components define through bores for fluid communication between tubular components, as well as electrical pathways formed along the tubular string. The mesh may be applied to any tubular component body along the electrical communication pathway. The mesh may be arranged around the through bore of the tubular component body, whether internal, external, or mid-tubing, to provide electrical communication along the tubular component body and still allow fluid flow or passage of components, etc. through the through bore. Non-limiting examples of tubular component bodies include a multilateral junction (and/or the individual legs thereof), a deflector assembly, a segment of casing or production tubing extending along the well, a connector body (e.g., an inductive coupler, a wet-mate, etc.), and other non-limiting examples described below. Using a mesh (or multiple small-area electrical conduits) instead of conventional means of passing electrical lines in applications where there is limited room (small gaps).

In lower-risk environments where there are no significant concerns a control line may be damaged, electrical wires may conventionally be run inside a "bare" control line. For example, one conventional method of running electrical lines in a wellbore is to encapsulate the wires in a ¼ inch control line and then encapsulate the control line in plastic material. In severe environments, the encapsulation may be made wider and include metal cables to add additional protection to the electrical wires. In still other environments, however, an even more robust electrical communication pathway is desirable. For example, running bare control lines and stabbing them into tools with small IDs is not desirable. Thus, the disclosed mesh in all of its configurations and uses may provide a more reliable and robust electrical connection for signal and power downhole.

There are many possible technical advantages of using a mesh sleeve. In one aspect, the use of a mesh or woven conductor may increase the current carrying capacity over the net capacity of individual wires. In addition, or in the alternative, redundancy (e.g., double or even triple redundancy) can be achieved by running multiples wires in a mesh configuration.

At least a portion of the electrical pathways may be defined by the electrically conductive mesh disposed around the through bores of one or more tubular components. The mesh includes one or more electrical conductors, which collectively provide a very robust and reliable electrical pathway. Depending on the configuration, at least some of the electrical conductors may be bare (non-insulated) to form a single but very robust transmission path. Alternatively, one or more of the conductors could be insulated in order to transmit electrical power/data separately from other conductors in the mesh. Some embodiments include a multilayer mesh with layers of insulation therebetween, such as for separately conducting electrical signals along one of the mesh layers and electrical power along another of the mesh layers.

In some examples, the mesh may include wire mesh having one or more electrical conductors for use in power and/or data signal transmission. The arrangement of conductors in a mesh-type configuration allow higher energy/power density to be run through a thin-walled device or cross-section. The conductors may be run in parallel, which may include a higher proportion of a thin cross-sectional area that can be utilized for energy transfer more efficiently (e.g., having decreased power loss) than if only a few thicker conductors were used. Further, mesh may continue to transmit power in the event of a breakage of one or more strands of the mesh.

Aspects of this disclosure may be applied to any well system having tubular equipment in which a network of electrical and fluid communication pathways are provided. Examples are discussed below in the context of a multilateral well, but the disclosed principles may be applied to other well systems and not exclusively to a multilateral well system. The mesh may be formed as an electrically conductive sleeve around the through bore of tubular equipment, such as along one or both legs of a multilateral junction or along tubular segments interconnecting various tubular components. Connectors may also be provided for releasably connecting tubular components to establish electrical and/or fluid communication pathways therebetween. Such connectors may be configured for connecting a retrievable downhole tool with another tubular component downhole. The connections and the mesh communication pathways may ensure reliable electronic power and data transmission from the surface to downhole portions of a multilateral well, including the main wellbore and to wellbore branches. This connection and method may facilitate the downhole coupling and de-coupling of two devices, such as between a junction leg of the disclosed multilateral junction with the bore of a downhole completions assembly that receives the junction leg.

The electrical connections may be used to provide power, data, controller functionality, logic, computational transmission, etc. to one local within a well to another local (including the surface). The electrical connections may be used to provide sensed data about the connector itself (e.g., position, oil temperature, forces, pressures, etc.) The connector may incorporate resistance (e.g., springs or other biasing mechanism), controlled resistance (e.g., a damper such as a hydraulic-controlled cylinder, etc.) to control the rate-of-movement and forces during engagement of systems, operation of system(s), e.g., control shocks/vibration due to natural events such as gas breaking out of oil violently, human-intervention operations, stimulations, cool-down issues, etc. Other features may be used to monitor the well's parameters, equipment's parameters, natural-occurring variables, and other parameters.

FIG. 1 is an elevation view of a completions system 10 in a multilateral well 16, as an example of a well system in which embodiments of the present disclosure may be implemented. The multilateral well 16 is formed below a surface 14 of a well site 12. The surface 14 may represent ground level of a land-based well site or the sea floor of a subsea or offshore well site, for example. Various surface equipment 29 may be located at or above the surface 14 for supporting drilling and completion of the multilateral well 16. The surface equipment may include, for example, a rig for supporting downhole equipment as it is lowered into the well 16, fluid systems for circulating fluid to and from surface 14. The completions system 10 include tubular equipment for conveying fluids to and from the surface 14. The completions system 10 also includes an electrical network comprising electrical communication pathways for communicating power and data between a plurality of downhole control and/or sensor devices 24 and/or between the surface equipment and the downhole control and/or sensor devices 24. The completions system 10 may comprise a category generally referred to as intelligent completions, wherein electronic controls are implemented to monitor and control production of hydrocarbons. Thus, reliable and robust electrical equipment and connections are desired, as provided by aspects of this disclosure.

The multilateral well 16 includes a main bore 18 which may include a vertical portion extending from surface 14 and which transitions to a horizontal portion further below the surface 14. At least a portion of the main bore 18 may be lined with a string of casing 28. Components of the casing 28 may include a liner hanger 28A and liner 28B. The multilateral well 16 includes any number of lateral wellbores (i.e., laterals) 20 that intersect the main bore 18, and in this example includes first and second laterals 20A, 20B. Laterals may be formed in any suitable manner, such as using some version of a whipstock assembly or its equivalent. A production packer 19 seals the well 16 above where the completions system 10 or lower components thereof are installed. The production packer 19 may seal an annulus between a tubular string 17 which may include upper components (not shown) of the completions system 10. The tubular string 17 may be formed from a plurality of tubular components including tubing segments (e.g., production tubing, casing components, etc.) primarily for conveying fluids and other tubular well components (e.g., multilateral junctions, multilateral completion deflectors) having internal through bores in fluid communication with other components of the tubular string. The electrical network comprises various electrical communication pathways in the multilateral well 16. This electrical network may include an upper umbilical 15 extending along the tubular string 17 to surface, which may provide one or more electrical communication pathway for transmission of power and data between the surface 14 and lower components of the completions system 10.

Tubular well components of the completions system 10 may include any number of multilateral junctions for reinforcing the well 16 at the intersections with the main bore 18 and laterals 20. In the illustrated embodiment, the completions system includes an upper multilateral junction 40A at an intersection between the main bore 18 and the upper lateral 20A and a lower multilateral junction 40B at an intersection between the main bore 18 and the lower lateral 20B. The upper multilateral junction 40A includes a first leg (i.e., lateral bore leg) 42 disposed in the upper lateral 20A and a second leg (i.e., main bore leg) 44 disposed in the main wellbore 18. Similarly, the lower multilateral junction 40B includes a lateral bore leg 42 disposed in the lower lateral 20B and a main bore leg 44 disposed in the main wellbore 18. An internal through bore of each multilateral junction 40 branches internally, with an internal through bore of the lateral bore leg 42 in fluid communication with the lateral wellbore of the multilateral well, and an internal through bore of the main bore leg 44 in fluid communication with the main wellbore of the multilateral well. The two multilateral junctions 40A, 40B may be discussed generally to refer to similar features, but the multilateral junctions are not required to be identical.

The completions system 10 of FIG. 1 is an example of a well system in which there are multiple well tools to be connected to establish electrical and fluid communication between different parts of the completions system 10. For example, the multilateral well 16 may require an electrical and fluid connection to be made where a well tool is tripped downhole to land in one of the legs 42, 44 of one of the multilateral junctions 40. Such connections may also be required between each leg 42, 44 of a multilateral junction with the respective lateral or main bore portion downhole of the legs 42, 44. Each connection may be required to provide both fluid and electrical communication across the connection between any two points in the multilateral well 16 on either side of the connection.

A variety of electronic devices are arranged along the tubular string. As illustrated, for example, the plurality of control and/or sensor devices 24 may be disposed within each lateral 20A, 20B as part of the completions system 10. The control and/or sensor devices 24 may include or be operatively connected with controllable production valves, for example, to selectively control production flow from different laterals or from different portions of each lateral 20. The upper multilateral junction 40A may provide electrical pathways along its tubular body to couple wiring (e.g., the upper umbilical 15) to corresponding wiring routed along a tubular body of the lateral bore leg 42 (e.g., upper lateral umbilical 21) to provide electrical power and/or communication signals to the plurality of control and/or sensor devices 24 in the upper lateral 20A. The upper multilateral junction 40A may also provide electrical pathways along its tubular body to couple wiring (e.g., the upper umbilical 15) to corresponding wiring routed along a tubular body of the main bore leg 44 (e.g., upper main umbilical) to provide electrical power and/or communication signals to the plurality of control and/or sensor devices 24 at or below the upper multilateral junction 40A including to one or more deflectors, anchors, packers, or other a variety of other equipment known in the exploration, drilling, completion, reservoir analysis, geological evaluation, seismicity, injection of one or more fluids, evaluation of one or more sensed parameters and production and control of hydrocarbons. Likewise, the lower multilateral junction 40B may provide electrical pathways along its tubular body to couple wiring (e.g., the upper umbilical 15 or upper lateral umbilical 21) to corresponding wiring along the tubular body of the lateral bore leg 42 (e.g., lower lateral umbilical 23) to provide electrical power and/or communication signals to the plurality of control and/or sensor devices 24 in the lower lateral 20B. The lower multilateral junction 40B may also provide electrical pathways along its tubular body to couple wiring (e.g., a lower main bore umbilical) to provide electrical power and/or communication signals to the plurality of control and/or sensor devices 24 in a lower main bore 18B. Again, the upper umbilical 15, lower umbilical, other umbilical or combination thereof may provide power and/or communication signals, to and from, a variety of other equipment known in the exploration, drilling, completion, reservoir analysis and production and control of hydrocarbons and other fluids. In at least some embodiments, the electrical power and communication signals may be sent from the surface 14 via the wiring (e.g., upper umbilical 15) to control operation of one or more downhole tools, such as downhole valves. Communication signals may also be sent from sensors or other devices, via the wiring, to the surface. As such, the wiring connection may allow the surface to remotely control devices and monitor reservoir zones via one or more well tool connections at the multilateral junctions 40.

The completions system 10 also includes a multilateral completion deflector 26 at each multilateral junction 40. In the illustrated embodiment, the deflector 26 at the upper junction 40A may be referred to as an upper multilateral completion deflector and the deflector 26 at the lower junction 40B may be referred to as a lower completion deflector. Each multilateral completion deflector 26 may be disposed directly downhole from a corresponding lateral 20 to deflect tools of the completions system out into the corresponding lateral 20. For example, each deflector 26 may be configured to deflect a lateral bore leg 42 of the respective multilateral junction 40. In at least some embodiments, each deflector 26 may provide a no-go location for the respective multilateral junction 40. The deflector 26 may have a large enough inner diameter (ID) for receiving a main bore leg 44 of the multilateral junction 40, so as to guide the main bore leg 44 of the multilateral junction 40 into its bore. The multilateral completion deflector may include features that reduce or eliminate bending stresses on the multilateral junction components. The multilateral completion deflector bore may be configured to restrict the flow area when the main bore leg of the multilateral junction enters with the intent to create a pressure increase that can be seen from surface.

When the multilateral junction 40 is landed or latched into the multilateral completion deflector or an assembly that includes the multilateral completion deflector, a hydraulic seal is formed in which the geological formation around the one or more casing junctions is hydraulically isolated from the internal bore of the multilateral junction and/or other casing junction(s). An alternative way to deflect the end of the pipe/string connected to the multilateral junction lateral bore leg into the lateral wellbore is to use a bent, articulating, sensor or weighted joint connected on the end of the pipe/string on end of a lateral bore leg of the multilateral junction.

Electronic and fluid flow pathways and connections may be provided between a variety of downhole components and tools. In the context of FIG. 1, just by way of example, when the main bore leg 44 of the respective multilateral junction 40 is lowered into the main bore 18 and lands in the multilateral completion deflector 26, the main bore leg 44, extends through the completion deflector 26 to provide fluid communication therebetween, and to electrically connect with another component 47, attached below the liner hanger. In an alternative configuration of FIG. 1, the connection 45 could alternatively be formed between the main bore leg 44 (as one well tool) and the completion deflector 26 (as another well tool), but such other configuration may require another energy transfer device between the completion deflector and the lower completion. The connection 45 may comprise one or more electrical, mechanical, and fluid connection. The electrical connection permits the transmission of electrical power and/or signals across the connection. The fluid connection permits the flow of fluids across the connection, such as produced hydrocarbons (subject to valves and other flow controls). The mechanical connection may be a releasable connection that physically holds the devices together, to thereby maintain the electrical and fluid connection, until the connection is released. In some embodiments, the mechanical connection allows relative movement between the main bore leg 44 and the well tool to which it is connected (e.g., the deflector 26 or other equipment below the liner hanger) while maintaining the electrical and fluid connections, as further described below and shown in subsequent figures.

The electrical connection may be made in a number of ways, either through direct or indirect electrical contact or contactless (e.g., inductive) electrical communication between corresponding connector bodies. In some cases, the electrical connection comprises an energy transfer mechanism (ETM) 46 on the multilateral junction with a corresponding ETM 146 on or connected to an anchoring device of the multilateral completion deflector 26. Each ETM 46 can transfer electrical power and data communication to other ancillary devices to which it is connected in an adjoining lateral wellbore and/or main wellbore, such as via an electrical conduit or wirelessly, and said ancillary devices can transfer communication back to the respective ETM 46. The ETMs 46 may communicate with each other across the connection 45. Thus, power and communication may be transferred from surface 14 to the uppermost ETM in the well and said ETM can transfer communication back to surface 14 or some local between the two.

In some configurations, the ETM may rely on physical (director or indirect) electrical contact between components of the mating connector bodies, including corresponding first and second electrical contacts that are positioned for contact when one connector body is releasably secured to the other connector body. In other configurations, an ETM may be a wireless energy transfer mechanism (WETM) including an inductive coupler for electrically coupling the first and second connector bodies without direct electrical contact with each other when the connector bodies are releasably secured.

The system may include use of one or more system test tools for monitoring Inductive Couplers, systems, methods, etc. The system may include one or more of linear slip rings to assist with aligning a multilateral junction to an anchoring device required for a multilateral completion deflector. The device or method to transfer power or communications to a lower wellbores may or may not be reliant on the device or method to transfer power or communications to wellbore. The method of which the anchoring devices for the multilateral junction are conveyed, allows for frequent and intermittent axial orientation checks via a pressure pulse device such as measurement while drilling (MWD) tool, a work string orientation tool (WOT), etc. Moreover, the system may include use of an isolation device between the lateral wellbores that can be opened and closed repeatedly.

Thus, reliable communication of electrical power and data is desirable throughout the above-described example system. One aspect of this disclosure is the use of an electrically conductive mesh disposed along the various tubular components and connections, while allowing fluid communication through the tubular components and connections. The mesh may be configured for use at any location in this system where a robust electrical pathway is desirable. For example, the mesh may be arranged along a portion of tubular string between components of the system 10 to provide electrical transmission between those components. The mesh may also be arranged along a tubular body of a well tool to provide electrical transmission from a first portion of the well tool to a second portion of the well tool spaced along a tubular bore of the well tool. In any case, the mesh may be arranged around the through bore of whatever tubular component body, to provide an electrical communication pathway while still allowing fluid flow or passage of tools, etc., through that through bore. Thus, "along" is not limited to meaning along the outside a tubular, nor inside a tubular, but could comprise inside, outside, layered within the OD and ID of the tubular, may be on the outside wall, but covered at least partially with a protective layer (steel protective sleeve, protective mesh, protective composite material, e.g., steel and a plastic coating).

For example, in some embodiments, the deflector assembly 26 (which is another example of a tubular well component) or one or more of the multilateral junctions 40 may be configured to transfer power from a first portion of the deflector assembly 26 or junction 40 to a second portion of the deflector assembly 26 or junction 40 via transmission lines. The transmission lines may transmit electrical, hydraulic, electro-magnetic, magnetic, acoustic, light energy, and/or other type of energy. The transmission lines may transmit one form of energy (e.g., electricity) which may be transformed into another form of energy (e.g., electricity to power an electric motor, electricity to power a hydraulic pump, electricity to power a rf transmitter, etc.). The transmission line may comprise one-way, bi-directional, common ground, separate grounds, co-axial. Further, the transmission lines may include energy converters, transformers, and/or storage devices. The transmission lines may be located exterior to the entire deflector assembly 26, junction 40, or other well tool, or a portion thereof, or interior or mid-wall of the deflector assembly 26, junction 40, or other well tool.

The transmission lines may be one or more, or a combination of wire, cable, tubular, mesh, and other devices, combination of devices, methodologies know to those skilled in one or more arts, and yet-to-be invented or discovered or used singularly or in one or more combinations thereof. The transmission lines may be configured to transition from exterior, interior, or internal the deflector assembly to internal, interior, or exterior the deflector assembly or any combination thereof. Such transmission lines need not be exclusively mesh. Rather, a mesh sleeve may be incorporated at select locations to provide the advantages of mesh such as robust electrical connections and redundancy.

In addition to mesh, the transmission lines of the system 10 at various locations may also include other types of electrical conductors, including electrical cables (e.g., group or bundle of multiple wires inside a common sheathing), submersible cable, wires (e.g., single conductor or multi-conductor), and/or other transfer or distribution devices.

Some embodiments may also include fluid transmission (e.g., hydraulic) lines. The hydraulic lines may be a single conductor line (pipe, tube, etc.) or multi-conductor line (pipe, tube, etc.). In some embodiments, the hydraulic lines include a submersible cable configured for operation in wet or submersed locations. The submersible cable may be very rugged, abrasion-resilient and extremely durable and reliable to meet the challenges present in the installation and operational environments. Further, the submersible cable may have a single as well as multiple conductor design having flat or round structure to meet its applications. The submersible cable may also include conductors with earth connections as well as the control wires that runs along the power conductors. Moreover, the transmission lines may include fiber optic cable or other energy-transfer technology or combination of any or all.

Figure 2:
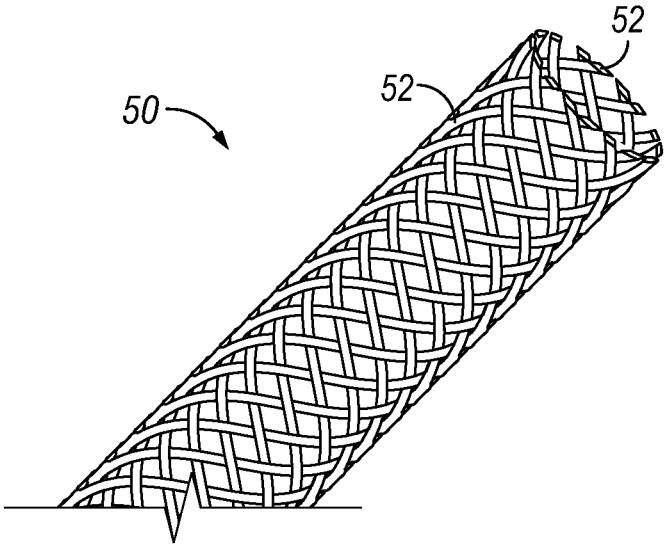
FIG. 2 is a side view of an electrically conductive mesh formed in a sleeve shape according to an example configuration.

FIG. 2 is a side view of an electrically conductive mesh 50 formed in a sleeve shape according to an example configuration. The conductive mesh 50 may be used anywhere in a well system where tubular equipment requires a robust power/signal transmission medium. The mesh 50 has a generally tubular arrangement of electrical conductors 52. The electrical conductors 52 in this example are in a woven arrangement, although other conductor arrangements are within the scope of this disclosure. One or more of the electrical conductors 52 may be bare (non-insulated) as shown, and in contact with one another, to form a single but very robust transmission line from that subset of electrical conductors. Alternatively, one or more of the conductors 52 could be insulated in order to transmit electrical power/data separately from other conductors in the mesh 50. The arrangement of the conductors 52 in a woven, mesh-type configuration as shown allows a high energy/power density to be ran through an otherwise thin-walled device or cross-section. The arrangement of the conductors 52 in a sleeve configuration as shown allows the mesh 50 to be arranged about the tubular section of a tubular string, such as along a length of tubing or around the through bore of a well tool, internally, externally, or mid-wall to the tubing or well tool. Several non-limiting example configurations of electrical conductors and electrical conductor sets are given below.

As further detailed herein, the mesh configuration (as well as individual conductors) may be run between the OD and the ID of a tubular component body. Those skilled in the art will appreciate that any of a myriad of manufacturing techniques may be used to form the mesh and install along a tubular component. Suitable techniques include, but are not limited to, for example, swaging, heat-shrink, bond (mechanically, chemically, or other means/methods), internal supports, sealed ends, etc. For example, the mesh, or just electrical conductors may be laid on the OD of the inner tube and they are both slide inside an out tube with a slightly larger ID. Once in position, a swage may be drawn through the ID of the inner mandrel causing the inner mandrel to expand radially outwards to contact the ID of the outer mandrel. The swaging force may be exerted against the conductive wires, or the weave. If the stress is too high, one or more spacers may be implemented in the gap to protect the electrical conductors, etc. for excessive swaging/forming forces. In some embodiments the expansion of the inner tube may be desirable to be enough to slightly expand the inner ID of the outer mandrel so that when the swaging force is removed, the inner ID of the outer mandrel will compress against the ID of the OD of the inner mandrel to hold them securely together. In some embodiments, adhesives, welding, brazing, or other processes/material may be utilized to secure the mandrels together, secures the electoral conductors, both etc.

Figure 3:
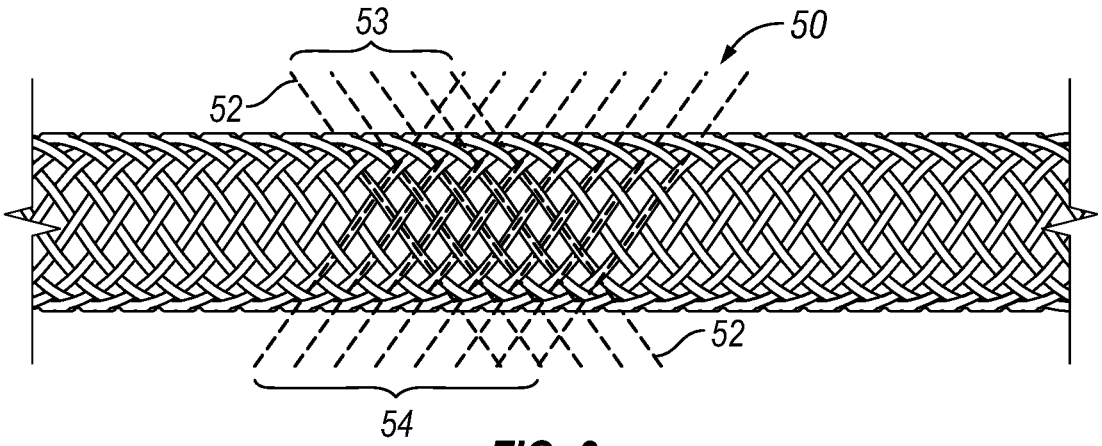
FIG. 3 is an example configuration of the mesh comprising a first set of wires woven with a second set of wires.

FIG. 3 is an example configuration of the mesh 50, wherein the one or more conductors 52 (e.g., wires) comprising a first set 53 of wires woven with a second set 54 of wires. Note that each individual wire of each set may have its own insulation. After the wires are coated individually, the wires of the first and second sets 53, 54 may be woven into a pattern such as shown in the figure. After the wires are woven together, the weave (and wires) may be coated with a protective coating, an insulative coating, or combination thereof. The coating may be applied to the inside of the weave, outside of the weave or both. During the installation phase, mechanical and/or thermal processes may be used. For example, the ends of one or more wires in the first set 53 may be electrically-conductively joined together by mechanical means such as crimping, twisting, etc. Thermal (fusion) processes such as soldering, laser-welded, electron-beam welded may be implemented or a combination thereof. One or more wires of each set 53, 54 may be electrically coupled, and the more wires connected together the more amperage can be passed through the wires. Likewise, higher voltages can be utilized when more, and/or better, insulation is used. In some configurations, the mesh 50 may include multiple conductors run in parallel (electrically and/or spatially).

Figure 4:
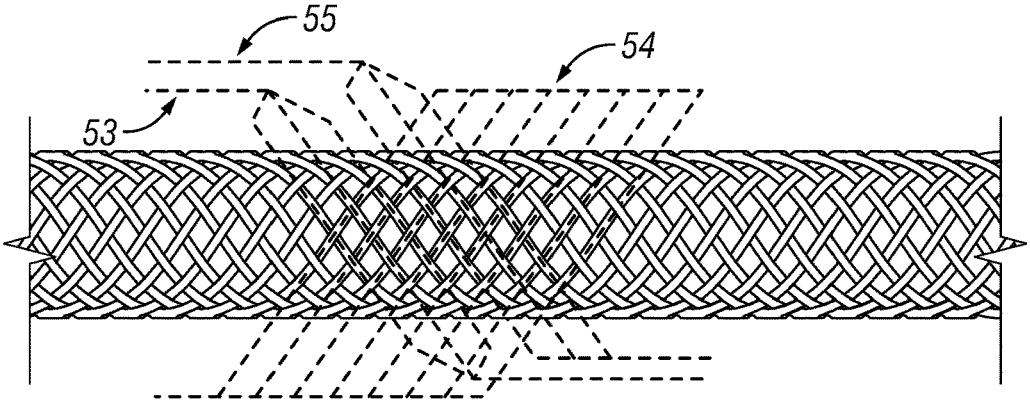
FIG. 4 is an example configuration of a mesh that includes multiple sets of wires are spatially and electrically in parallel.

FIG. 4 is an example configuration of a mesh that includes multiple set 53, 54, 55 of conductors. Within each set 53, 54, 55, the individual wires are spatially and electrically in parallel. The first set 53 is spatially and electrically parallel to the third set 55. The second set 54 is electrically parallel to the first and third sets 53, 55, but spatially, the wires of the second set 54 are diagonally intersecting, e.g., woven with, the wires of the first and third sets 53, 55. This may provide a higher proportion of a thin cross-sectional area that can be utilized for energy transfer more efficiently (e.g., have decreased power loss) than if only a few thicker conductors were used. Further, the mesh may continue to transmit power in the event of a breakage of one or more strands of the mesh.

Figure 5:
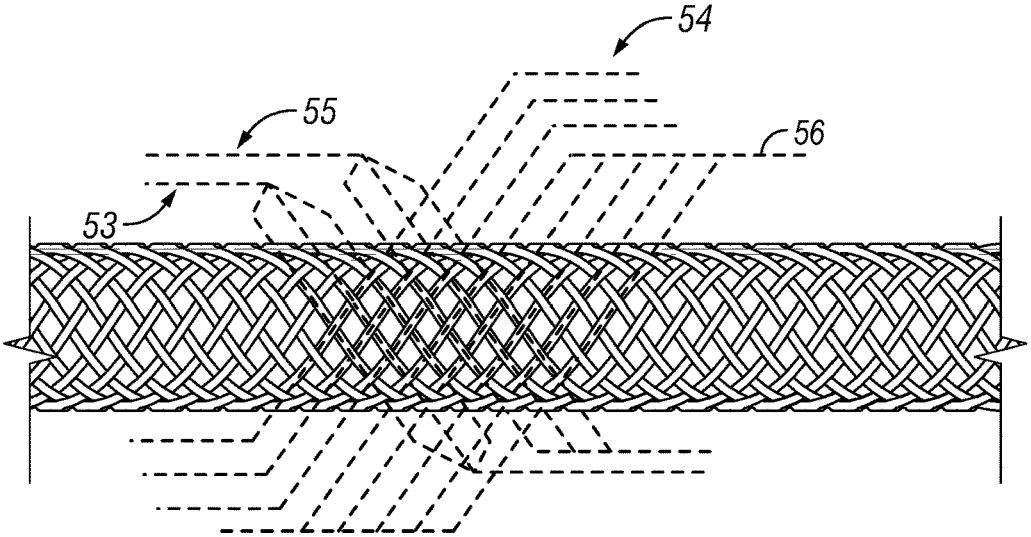
FIG. 5 is an example embodiment illustrating multiple wires in series.

In some configurations, the mesh may include multiple conductors run in series. FIG. 5 is an example embodiment with four sets of conductors 53, 54, 55, 56. The first and third sets 53, 55 are run in parallel as in FIG. 4. However, the second set 54 of conductors are now in series to one another and they are in series with the first, second, and fourth sets 53, 55, 56 of wires. Another aspect of the FIG. 5 configuration is that the first, second, and fourth sets 53, 55, 56 may be multi-strand conductors, whereas the second set 54 may be single-strand conductors. Multiwire conductors have a technical advantage such as being more flexible than a single strand carrying the same amount of current.

In any of a variety of configurations, the mesh may permit power and communication transmission through separate conductors of the same mesh. That is, some conductors may serve as communication lines while others may serve as power transmission lines. For example, the multi-strand first and third sets 53, 55 of FIG. 5 may serve as power lines since their aggregate large cross-sectional area may carry more current than a thinner conductor such as in the second set 54.

Figure 6:
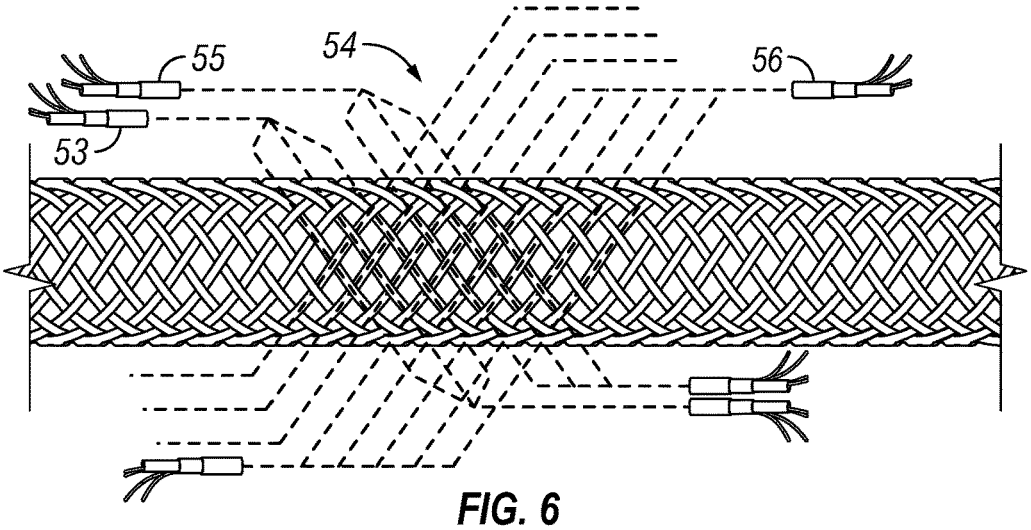
FIG. 6 is an example embodiment of a mesh wherein each set of wires may be a separate co-axial cable.

Different physical arrangements of conductors are of course possible to achieve the different electrical wiring configurations of these example mesh configurations. For example, FIG. 6 is a diagram of the mesh configuration of FIG. 5, illustrating how the first, second, and fourth sets 53, 54, and 56 may be a separate co-axial cables, wherein the individual conductors of each set are within the respective cable.

In some configurations, different sets of wires may be woven together where they are in electrical contact with one another or woven together but insulated so as not to be in electrical contact with one another. Both of these examples may be accomplished with a single-layer mesh. In other embodiments, different sets of wires may be arranged in separate layers where the layers are in electrical contact or electrically insulated. The layers maybe shielded from one another.

Figure 7:
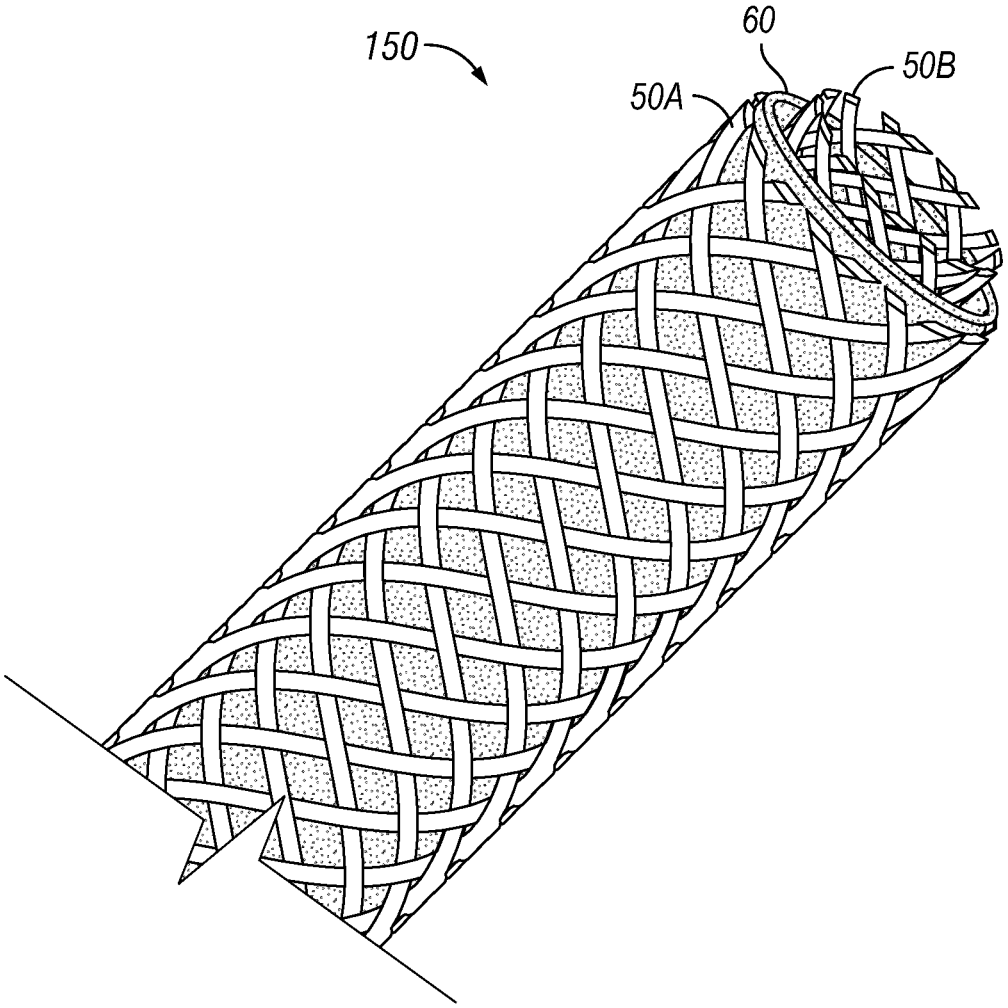
FIG. 7 is a perspective view of a dual-layer mesh sleeve according to an example configuration that incorporates two layers of mesh separated by an insulation layer.

FIG. 7 is a perspective view of a dual-layer mesh sleeve 150 that incorporates two layers of mesh, such as the mesh construction generally disclosed in FIG. 2. In particular, the mesh sleeve 150 in this example includes a first, outer mesh layer 50A and a second, inner mesh layer 50B separated by an insulation layer 60. Although two mesh layers are included by way of example, any number of mesh layers could be conceivably included subject to space limitations of the well system into which they are incorporated. Further, the mesh sleeve 150 in FIG. 3 may be configured as a dual-layered thin mesh, in that a wall thickness of each mesh layer 50A, 50B may be thinner than a single mesh sleeve embodiment. In some examples, the overall thickness of the dual-layered thin mesh including insulation layer 60 may be not substantially thicker than a wall thickness of a single-layered mesh sleeve. In some embodiments, the dual-layer mesh sleeve 150 may be used to separate power and signal communication. For example, one of the mesh layers 50A, 50B may be for electrical signal communication and the other mesh layer 50A or 50B for electrical power transmission. The insulation layer 60 used to shield the outer mesh layer 50A from the inner mesh layer 50B may comprise any suitable insulation material. In this example, the insulation layer 60 is formed as a continuous tube of insulating material. In other embodiments, strands 52A or 52B of either or both layer may be individually insulated.

In some embodiments, the mesh includes an expandable mesh and an insulation feature. The insulation feature is configured to support and insulate the mesh when expanded. Further the insulation feature is configured to protect the mesh from fluids, erosion, chemical degradation, and/or mechanicals stresses. Moreover, the insulation material may be configured to secure the mesh to other surfaces. For example, the insulation material may be configured to secure the mesh to inner areas, outer areas, through-holes, grooves, threads, ports, slots, or other features of the tubular component body (e.g., completion tubing, deflector or multilateral junction). In some embodiments, the mesh is secured to the deflector assembly via, a securing mechanism (e.g., bonding, fastener, braze, fuse, weld, etc.).

In some embodiments, the mesh may include metal and/or alloys, and/or properties including, gold, silver, copper, nitinol, chemical-eluting, chemical-absorbing, dual-acting, electrical-conductive materials, electrical-magnetic conductive materials, pressure membranes, optical-reflective properties, optical-properties, optical-transmission properties, radio-frequencies properties. Further, the mesh may include welded wire mesh, fused mesh, woven wire mesh, expanded wire mesh, expanded metal sheet, perforated metal sheet, welded metal sheet, any combination thereof, other combinations, in any condition (including, but not limited to pre-expanded, post-expanded, semi-expanded). Such materials are generally understood in the art apart from their specific uses taught in this disclosure. Moreover, a mesh assembly having the mesh and the insulation feature, may include electrical-insulating materials, dielectric materials, wear resistant coating, wear resistant material, thermoelastic material, thermoplastic material, heat-curable material, heat activated material, UV curable material, pressure-activated material, thickeners, thinners, solvents, solutes, activators, stabilizers, and/or adhesives (e.g., one-part, two-part, multi-part, etc.).

As set forth above, the transmission lines may include electrical cable, wires, and/or mesh, etc. The cables may include coaxial cable (e.g., twin-axial, semi-rigid coaxial, rigid line coaxial), twisted pair cable (e.g. unshielded twisted pair, shielded twisted pair), metallic sheathed cable (e.g., armored cable, metal clad cable), multi-conductor cable, multicore cable, paired cable, shielded or screened cable, single conductor wire (e.g., singled stranded wire, single solid wire), twin lead (e.g., ladder line), underground feeder (UF) cable, and/or flexible cables (e.g., stranding in layer, stranding in bundles). Embodiment may include one or more of the above, separately or in one or more combinations. Also, other devices, materials, components, devices, methods, procedures, processes, systems—known to those skilled in one or more arts—and not yet invented, combined, tested or tried at the time of this invention. The individual wires, collection of wires, and one or more layers of wires may comprise methods, material, processes to reduce electromagnetic interference (EMI), or radio frequency interference (RFI). Electromagnetic interference (EMI), or radio frequency interference (RFI) as it's also referred to, is an electronic disturbance generated by external electronic or electrical sources such as electrostatic coupling, electromagnetic radiation, or electrical circuit noise.

Some methods/processes to reduce or eliminate EMI include the use of shielded twisted pair cable (STP) which has the individual pairs of wires wrapped in foil, which are then wrapped again for double protection. Unshielded twisted pair cable (UTP) techniques may be utilized which has each pair of wires twisted together. Those wires are then wrapped in tubing without any other protection. A coaxial cable, mesh, and/or layers thereof, etc., may comprise a conductor and two or more layers of insulation and shielding which to prevent EMI (e.g. crosstalk) from motors, sensors, controllers and other sources of EMI.

Figure 8:
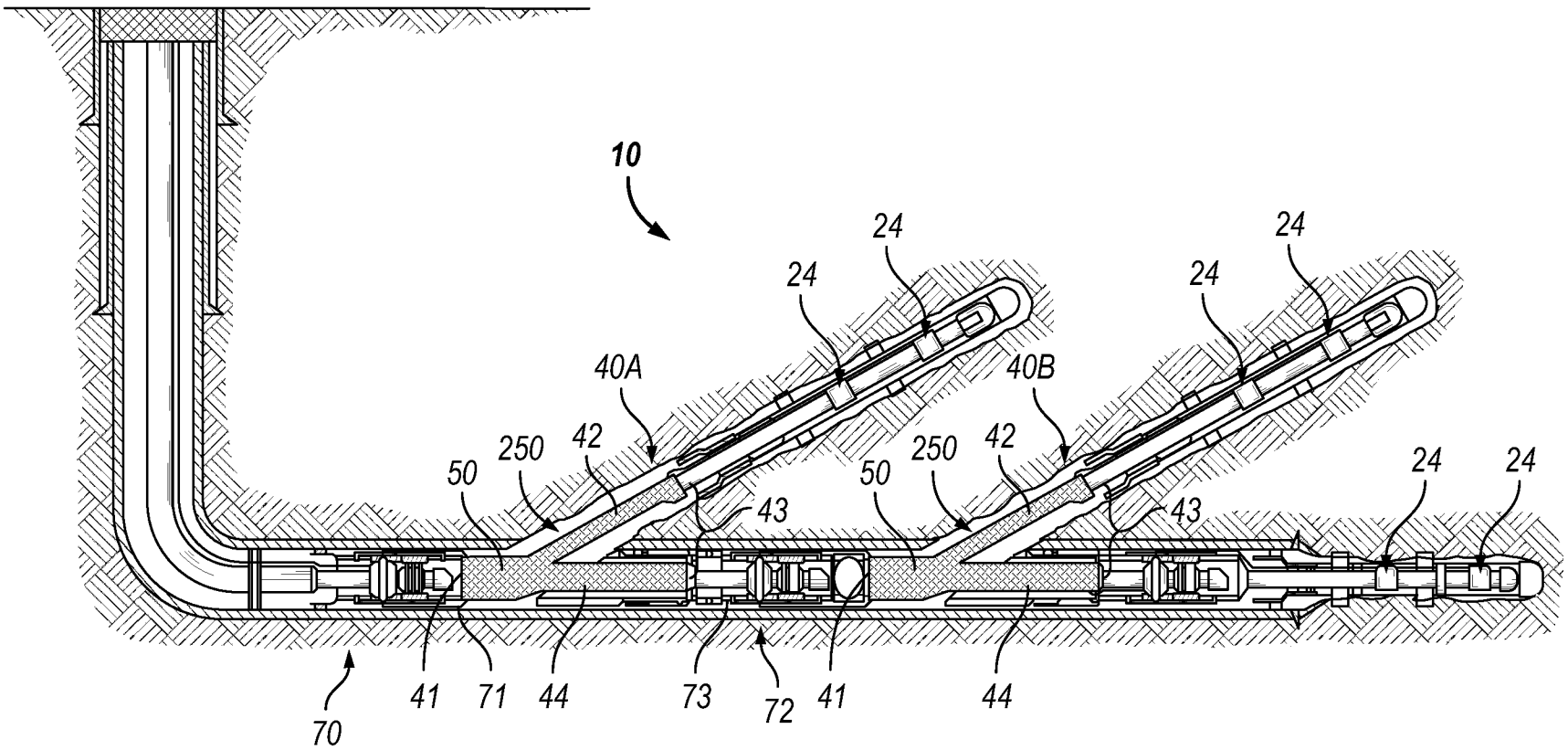
FIG. 8 is an elevation view of the completions system of FIG. 1, wherein the conductive mesh has been incorporated, by way of example, into the two multilateral junctions.

FIG. 8 is an elevation view of the completions system 10 of FIG. 1, wherein the conductive mesh 50 has been incorporated, by way of example, into the two multilateral junctions 40A, 40B. The conductive mesh 50 in this example is disposed around the through bores of each multilateral junction 40, from the singular through bore at an uphole end 41 of each junction and along the respective through bores that branch off into the main bore leg 44 and lateral bore leg 42 at a lower end 43 of each multilateral junction 40. In this example the mesh 50 is disposed around (generally co-axially with) the internal through bores of both the lateral bore leg 44 and main bore leg, but in other embodiments (e.g., see FIGS. 5 and 6) could be arranged along just a portion of the multilateral junction. The mesh 50 is thus formed as a y-shaped mesh sleeve 250 (or separate, singular mesh sleeves joined at their intersection) that conforms in this example to the uphole end 41 and both legs 42, 44 of the multilateral junction 40.

The mesh sleeve 250 thereby defines one or more electrical pathway from the uphole end 41 to the lower end 43 (both legs 42, 44 in this example) for transferring electrical power and communication signals in the completions system 10 of the multilateral well 16. These electrical pathway(s) thus become part of the electrical network comprising electrical communication pathways for communicating power and data between downhole sensors and/or devices 24 and/or between the surface equipment and the downhole sensors and/or devices 24. The mesh 50 of the mesh sleeve 250 may include one or more electrical conductors coupling the uphole end 41 to the lateral bore leg 42 and one or more other electrical conductors separately coupling the uphole end 41 to the main bore leg 44. The electrical conductors may be insulated from each other so that signals may be independently routed to the lateral leg 42 and to the main bore leg 44. The uphole end 41 of each multilateral junction 40 is connected to an uphole portion of the completion system 10 (i.e., uphole of that multilateral junction) and the lower end 43 is connected to a downhole portion of the completion system 10 (i.e., downhole of that multilateral junction). For example, the multilateral junction 40A may be connected to a tubing segment 71 of a portion 70 of the completion system 10 that is uphole of the multilateral junction 40A and to a tubing segment 73 of a portion 72 of the completion system 10 that is downhole of the multilateral junction 40B. The multilateral junction 40A may be placed in fluid and electrical communication (using a suitable electric/fluid connection) with the uphole portion 70 and downhole portion 72.

Figure 9:
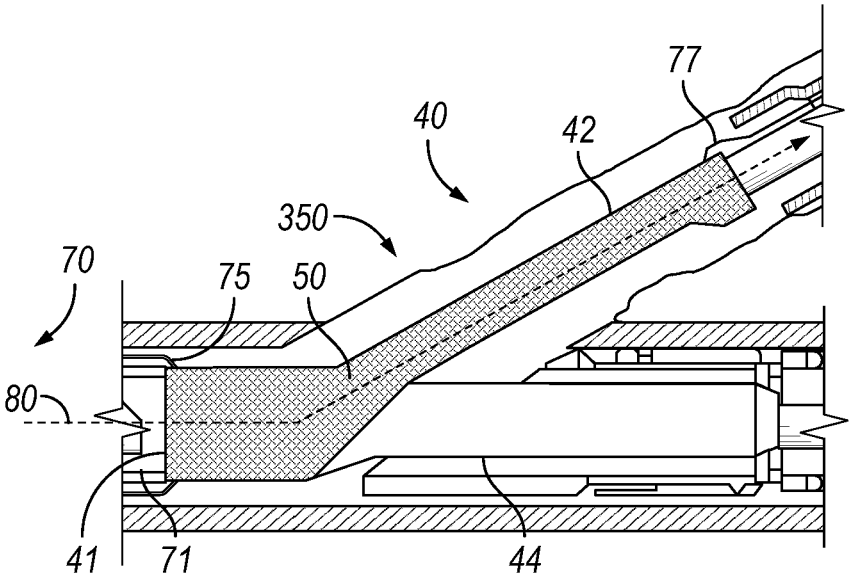
FIG. 9 is a side view of a multilateral junction wherein the mesh has been arranged along an upper end and a lateral bore leg of the multilateral junction.

FIG. 9 is a side view of a multilateral junction 40 wherein the mesh 50 has been arranged along just a portion of the multilateral junction. More specifically, in this example, the mesh 50 has been arranged around the upper end 41 and around the lateral bore leg 42, but not the main bore leg 44. Thus, the mesh 50 is arranged as a mesh sleeve 350 that conforms to the upper end and lateral bore leg 42 of the multilateral junction 40 for electrical power and/or signal transmission from the upper end 41 to the lateral bore leg 42. The connection between the uphole end 41 and the tubing segment 71 may provide electrical and fluid communication between the uphole portion 70 and the multilateral junction 40. An electrical terminal 75, for example, may be in electrical contact with the mesh 50 at the upper end 41 of the junction 40 and another electrical terminal 77 may be in electrical contact with the mesh 50 at the lateral bore leg 42. Fluid communication may be provided simultaneously along a flow path 80 up the lateral leg 42 while electrical communication occurs along the mesh sleeve 350 surrounding the lateral leg 42. Fluid communication may also occur along the main bore leg 44. Although no mesh is shown on the main bore leg 44, alternate electrical communication pathways may be formed if desired.

Figure 10:
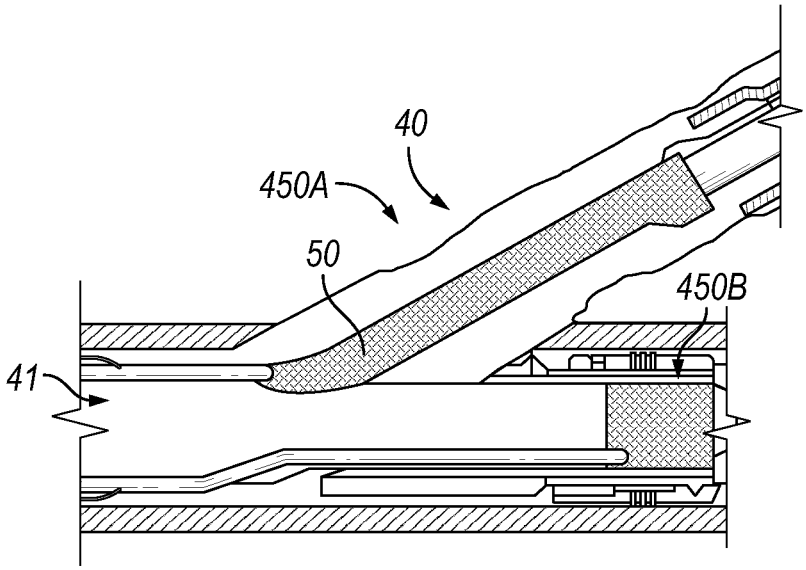
FIG. 10 is a side view of the multilateral junction wherein the mesh has instead been arranged along just the lateral bore leg 42 and around a lower half of the main bore leg.

FIG. 10 is a side view of the multilateral junction 40 wherein the mesh 50 has instead been arranged along just the lateral bore leg 42 and around a lower half of the main bore leg 44, but not around the upper end 41. Thus, the mesh 50 is arranged as separate mesh sleeves 450A and 450B that conforms to the lateral bore leg 42 and lower half of the main bore leg 44 of the multilateral junction 40. Although no mesh is shown on the remainder of the multilateral junction 40, alternate electrical communication pathways may be formed if desired.

In any given embodiment, an expandable mesh and an insulation feature may be utilized wherein the mesh may be transformed between two configurations, such as between a collapsed (shrunk) configuration and an expanded (enlarged) configuration. In one embodiment, an expandable, electrically-conductive mesh is formed in its expanded shape. Then this stent is coated with a coating—such as the plastic material use to make waterproof heat shrink tubing. Polyolefin based tubes, PVC based materials, elastomeric, FEP, PVDF, silicon rubber, PTFE, Viton, and other specialty materials. Heat-shrink tubing or materials incorporated into the mesh may allow it to consolidate and/or compress the conductors and materials to better conform to the physical constraints of tubular equipment.

In another embodiment, the mesh or mesh-and-insulation may be manufactured and/or installed in methods akin to a "finger trap" configuration whereby the diameter of the mesh may contract in response to axial tension.

Another embodiment may comprise the use of wire loom tubing cable sleeve split sleeving. In one embodiment, the axial fibers may comprise one or more electrical conduits. They may comprise conductors in series, in parallel, multiple conductors for different functions (power, communication, strength, protection, etc.). After the mesh is installed, the mesh may be welded along the seam.

Accordingly, the present disclosure provides a well system incorporating an electrically conductive mesh along portions of tubular equipment. The disclosed systems and methods may include any of the various features disclosed herein, including one or more of the following statements.

Statement 1. A tubular well component for a well system, the tubular well component comprising: a tubular component body disposable in a well, the tubular component body defining a through bore from an uphole end to a downhole end of the tubular component body; and a mesh sleeve arranged along the component body around the through bore of the tubular component body, the mesh sleeve comprising one or more electrical conductors for coupling a first portion of the well system at the uphole end of the component body to a second portion of the well system at the downhole end of the component body.

Statement 2. The well tool of Statement 1, further comprising: an uphole connector at the uphole end of the tubular component body, the uphole connector configured for releasably connecting the first portion of the well system in fluid communication with the through bore of the tubular component body and in electrical communication with the mesh sleeve.

Statement 3. The well tool of Statement 2, wherein the uphole connector is configured for releasably connecting a retrievable well tool of the well system in fluid communication with the through bore of the tubular component body and electrical communication with the mesh sleeve.

Statement 4. The well tool of Statement 2 or 3, further comprising: a downhole connector at the downhole end of the tubular component body, the downhole connector configured for releasably connecting the second portion of the well system in fluid communication with the through bore of the tubular component body and in electrical communication with the mesh sleeve.

Statement 5. The well tool of any of Statements 1-4, wherein the tubular component body comprises a multilateral junction including a main bore leg and a lateral bore leg, wherein the through bore of the tubular component body comprises a through bore diverging from the uphole end to each of the main bore leg and the lateral bore leg, and the mesh sleeve is disposed around the main bore leg or the lateral bore leg.

Statement 6. The well tool of Statement 5, wherein the mesh sleeve is disposed around both the main bore leg and lateral bore leg and the electrical conductors couple wiring uphole of the multilateral junction to wiring downhole of each of the main bore leg and lateral bore leg.

Statement 7. The well tool of any of Statements 1-6, wherein the tubular component body comprises a multilateral completion deflector.

Statement 8. The well tool of any of Statements 1-7, wherein the tubular component body comprises a segment of casing or production tubing extending along the well.

Statement 9. The well tool of any of Statements 1-8, wherein the one or more electrical conductors of the mesh sleeve comprise a plurality of electrical conductors run in parallel.

Statement 10. The well tool of any of Statements 1-9, wherein the mesh sleeve comprises a first mesh layer and a second mesh layer insulated from each other.

Statement 11. The well tool of Statement 10, wherein the first mesh layer is configured for electrical power transmission and the second mesh layer is configured for electrical signal transmission.

Statement 12. The well tool of any of Statements 1-11, wherein the mesh comprises welded wire mesh, fused mesh, woven wire mesh, expanded wire mesh, expanded metal sheet, perforated metal sheet, or welded metal sheet.

Statement 13. A well system, comprising: a tubular string disposed in a wellbore, the tubular string defining an internal fluid flow path for conveying fluids to or from a surface of a wellsite; a plurality of well components arranged along the tubular string; and an electrical network along the tubular string interconnecting the well components, the electrical network comprising a transmission path defined at least in part by a mesh sleeve disposed along the tubular string around the internal fluid flow path.

Statement 14. The well system of Statement 13, wherein the tubular string extends from a surface of the wellsite and the transmission path extends along the tubular string from the surface.

Statement 15. The well system of Statement 14, further comprising: a tubular well component positioned downhole, wherein the mesh sleeve is on the tubular well component; a retrievable downhole tool lowerable into connection with the tubular well component; and a connector configured for releasably connecting the retrievable well tool to the tubular well component in fluid communication with the through bore of the tubular string and in electrical communication with the mesh sleeve.

Statement 16. The well system of Statement 15, wherein the tubular well component comprises a multilateral junction or a multilateral completion deflector.

Statement 17. A method, comprising: transmitting fluid along an internal flow bore of a tubular string in a well; and transmitting electrical energy downhole along an electrical transmission path along the tubular string, the electrical transmission path defined at least in part by a mesh sleeve around the internal flow bore of the tubular string.

Statement 18. The method of Statement 17, wherein the mesh sleeve is arranged around a through bore of a tubular component body of the tubular string.

Statement 19. The method of Statement 18, further comprising: lowering a well tool into the well; and connecting the retrievable well tool with a downhole tubular component body, thereby establishing electrical communication between the well tool and the downhole tubular component body.

Statement 20. The method of Statement 19, further comprising: establishing fluid communication between the tubular string and the downhole tubular component body in response to the connecting the well tool.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A tubular well component for a well system, the tubular well component comprising:

a tubular component body disposable in a well, the tubular component body defining a through bore from an uphole end to a downhole end of the tubular component body;

a multi-layer mesh sleeve with at least two layers of insulation therebetween for separately conducting electrical signals along one of the mesh layers and electrical power along another of the mesh layers, wherein the multi-layer mesh sleeve is arranged along the component body around the through bore of the tubular component body, the multi-layer mesh sleeve comprising one or more electrical conductors for coupling a first portion of the well system at the uphole end of the component body to a second portion of the well system at the downhole end of the component body, wherein at least one electrical conductor is non-insulated relative to another electrical conductor; and an uphole connector at the uphole end of the tubular component body, the uphole connector configured for releasably connecting the first portion of the well system in fluid communication with the through bore of the tubular component body and in electrical communication with the multi-layer mesh sleeve.

2. The well tool of claim 1, wherein the uphole connector is configured for releasably connecting a retrievable well tool of the well system in fluid communication with the through bore of the tubular component body and electrical communication with the multi-layer mesh sleeve.

3. The well tool of claim 1, further comprising:

a downhole connector at the downhole end of the tubular component body, the downhole connector configured for releasably connecting the second portion of the well system in fluid communication with the through bore of the tubular component body and in electrical communication with the multi-layer mesh sleeve.

4. The well tool of claim 1, wherein the tubular component body comprises a multilateral junction including a main bore leg and a lateral bore leg, wherein the through bore of the tubular component body comprises a through bore diverging from the uphole end to each of the main bore leg and the lateral bore leg, and the multi-layer mesh sleeve is disposed around the main bore leg or the lateral bore leg.

5. The well tool of claim 4, wherein the multi-layer mesh sleeve is disposed around both the main bore leg and lateral bore leg and the electrical conductors couple wiring uphole of the multilateral junction to wiring downhole of each of the main bore leg and lateral bore leg.

6. The well tool of claim 1, wherein the tubular component body comprises a multilateral completion deflector.

7. The well tool of claim 1, wherein the tubular component body comprises a segment of casing or production tubing extending along the well.

8. The well tool of claim 1, wherein the one or more electrical conductors of the multi-layer mesh sleeve comprise a plurality of electrical conductors run in parallel.

9. The well tool of claim 1, wherein the multi-layer mesh comprises welded wire mesh, fused mesh, woven wire mesh, expanded wire mesh, expanded metal sheet, perforated metal sheet, or welded metal sheet.

10. A well system, comprising:

a tubular string disposed in a wellbore, the tubular string defining an internal fluid flow path for conveying fluids to or from a surface of a wellsite;

a plurality of well components arranged along the tubular string;

an electrical network along the tubular string interconnecting the well components, the electrical network comprising a transmission path defined at least in part by a multi-layer mesh sleeve disposed along the tubular string around the internal fluid flow path, wherein the multi-layer mesh sleeve conducts electrical signals along one of the mesh layers separately from electrical power along another of the mesh layers, wherein the multi-layer mesh comprises at least two layers of insulation in between the at least two mesh layers, wherein the multi-layer mesh sleeve comprises one or more electrical conductors for coupling a first portion of the well system to a second portion of the well system, wherein at least one electrical conductor is non-insulated relative to another electrical conductor;

a tubular well component positioned downhole, wherein the multi-layer mesh sleeve is on the tubular well component;

a retrievable downhole tool lowerable into connection with the tubular well component; and a connector configured for releasably connecting the retrievable downhole tool to the tubular well component in fluid communication with the through bore of the tubular string and in electrical communication with the multi-layer mesh sleeve.

11. The well system of claim 10, wherein the tubular string extends from a surface of the wellsite and the transmission path extends along the tubular string from the surface.

12. The well system of claim 10, wherein the tubular well component comprises a multilateral junction or a multilateral completion deflector.

13. A method, comprising:

transmitting fluid along an internal flow bore of a tubular string in a well; and transmitting electrical energy downhole along an electrical transmission path along the tubular string, the electrical transmission path defined at least in part by a multi-layer mesh sleeve around the internal flow bore of the tubular string and a connector configured for releasably connecting components of the tubular string to establish electrical and/or fluid communication pathways therebetween, wherein the multi-layer mesh sleeve conducts electrical signals along one of the mesh layers separately from electrical power along another of the mesh layers, wherein the multi-layer mesh comprises at least two layers of insulation in between the at least two mesh layers;

wherein the multi-layer mesh sleeve comprises one or more electrical conductors for coupling a first portion of the well system to a second portion of the well system, wherein at least one electrical conductor is non-insulated relative to another electrical conductor.

14. The method of claim 13, wherein the multi-layer mesh sleeve is arranged around a through bore of a tubular component body of the tubular string.

15. The method of claim 14, further comprising:

lowering a well tool into the well; and connecting the retrievable well tool with a downhole tubular component body, thereby establishing electrical communication between the well tool and the downhole tubular component body.

16. The method of claim 15, further comprising:

establishing fluid communication between the tubular string and the downhole tubular component body in response to the connecting the well tool.

* * * * *